US006419528B2

(12) United States Patent
Mullins et al.

(10) Patent No.: US 6,419,528 B2
(45) Date of Patent: Jul. 16, 2002

(54) FIELD REPLACEABLE UNIT

(75) Inventors: Barrie Jeremiah Mullins, Wicklow; Aedan Diarmuid Cailean Coffey, Kilkenny, both of (IE)

(73) Assignee: Richmount Computers Limited, Dublin (IE)

( * ) Notice: Subject to any disclaimer, the term of this patent is extended or adjusted under 35 U.S.C. 154(b) by 0 days.

(21) Appl. No.: 09/681,706

(22) Filed: May 23, 2001

(51) Int. Cl.[7] ..... H01R 13/24
(52) U.S. Cl. ..... 439/700; 361/727
(58) Field of Search ..... 439/700, 824, 439/297, 298, 490, 489, 488; 361/685, 724–727

(56) References Cited

U.S. PATENT DOCUMENTS 3,406,368 A * 10/1968 Curran ..... 439/700
5,509,813 A * 4/1996 Lu ..... 439/700
5,997,360 A * 12/1999 Gen-Kuong et al. ..... 439/700
6,050,658 A 4/2000 O'Sullivan et al.

* cited by examiner

*Primary Examiner*—Gary F. Paumen
*Assistant Examiner*—Felix O. Figueroa
(74) *Attorney, Agent, or Firm*—Oppedahl & Larson LLP

(57) ABSTRACT

A field replaceable unit comprises a housing having a front and a rear and is configured for sliding insertion into and out of a rack from its rear. The unit includes a connector for, in use, completing an electrical circuit from a backplane of the rack to a component of the field replaceable unit. The connector comprises a first rear projecting electrically conductive spring loaded member operative to engage an electrical pad on the backplane when the housing is inserted in the rack.

4 Claims, 2 Drawing Sheets

FIELD REPLACEABLE UNIT

BACKGROUND OF THE INVENTION

Conventional field replaceable units often include circuitry such as light emitting diodes (LED's), displays or buttons in a front plate accessible to an operator. This circuitry connects through printed circuit boards (PCBs) or cabling to a rear mounted connector. A complimentary connector for the front plate circuitry is located on a backplane, so that as the FRU is inserted into an enclosure, the FRU rear mounted connector, completing a circuit from the front of the unit to the rear of the unit, makes contact with this backplane connector. It has been recognised, however, that either of such FRU or backplane connectors may fail from time to time. In the case of the connector on the FRU, failure may simply require the replacement of the FRU. If the FRU is a disk shuttle—the enclosed disk may in fact be re-used if required. On the other hand if the backplane connector fails, then the entire backplane may need to be removed and even replaced at an extremely high cost.

This problem has been recognised in the case of LED outputs and solved by the replacement of the backplane connector with a LED, cooperating with a light pipe running the length of the FRU through to an aperture in the front plate 12. A disk shuttle example, of such an FRU is fully described in US Pat. No. 6,050,658 the disclosure of which is incorporated herein by reference. When this disk shuttle is inserted in the rack enclosure, the light pipe lies in register with the LED, so that when the LED is on, the light pipe transmits this light through to the front plate, so displaying the state of the LED at the front of the rack enclosure. This solution, however, does not solve the original problem in the case of liquid crystal display (LCD) displays or button inputs which may be located on the front-plate and so at the very least different components would be required for input or output signals.

The use of conventional connectors for completing circuits between a rack backplane and field replaceable unit involves additional cost in manufacturing the backplane to include extra connector components; and cost of PCB or cable for carrying a signal through to the front of the unit. It also exposes a system to a number of possible errors due to a large number of components including: backplane connector, field replaceable unit connector and field replaceable unit PCB or cables.

The present invention seeks to mitigate these problems and others of the prior art.

SUMMARY OF THE INVENTION

According to the present invention, there is provided a field replaceable unit comprising: a housing having a front and a rear and being configured for sliding insertion into and out of a rack from its rear; and a connector for, in use, completing an electrical circuit from a backplane of said rack to a component of said field replaceable unit, said connector comprising a first rear projecting electrically conductive spring loaded member operative to engage an electrical pad on said backplane when said housing is inserted in said rack.

Preferably, the field replaceable unit incorporates a front plate removably attached to said housing and including said component, and said connector comprises a second front projecting electrically conductive spring loaded member electrically coupled to said first electrically conductive spring loaded member and operative, when said front plate is attached to said housing, to engage a second pad electrically coupled to said component and disposed behind said front plate.

Using the present invention, the possibility of having a faulty connection between, say a backplane, and the field replaceable unit is reduced and problems associated with such a faulty connection are mitigated as, if such a fault occurs, only the field replaceable unit incorporating the connector need be replaced, rather than possibly having to replace an entire backplane to which the field replaceable unit as well as many other devices connect.

Furthermore, using the invention requires only the provision of simple pads on the backplane, so reducing the cost of the backplane, as there is no need for connectors, PCB's or cables.

The field replaceable unit of the invention can incorporate both input and output signal components using the same connectors so reducing manufacturing cost due to the reduced number of different parts required for a system.

BRIEF DESCRIPTION OF DRAWINGS

An embodiment of the invention will now be described with reference to the accompanying drawings, in which.

DETAILED DESCRIPTION

Figure 1:
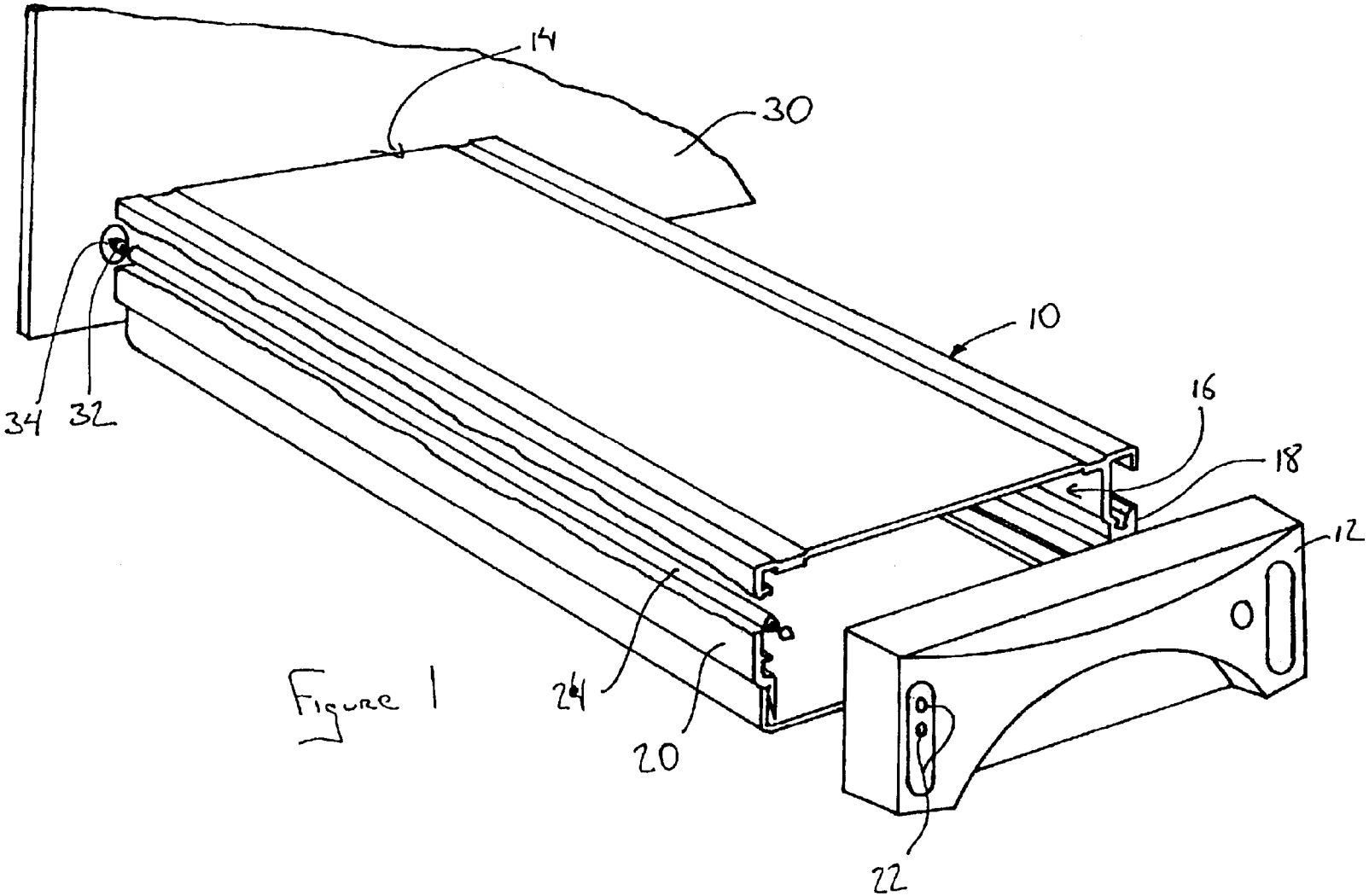
FIG. 1 is a perspective view of a disk shuttle according to a preferred embodiment of the invention in operation with a backplane.
Figure 2:
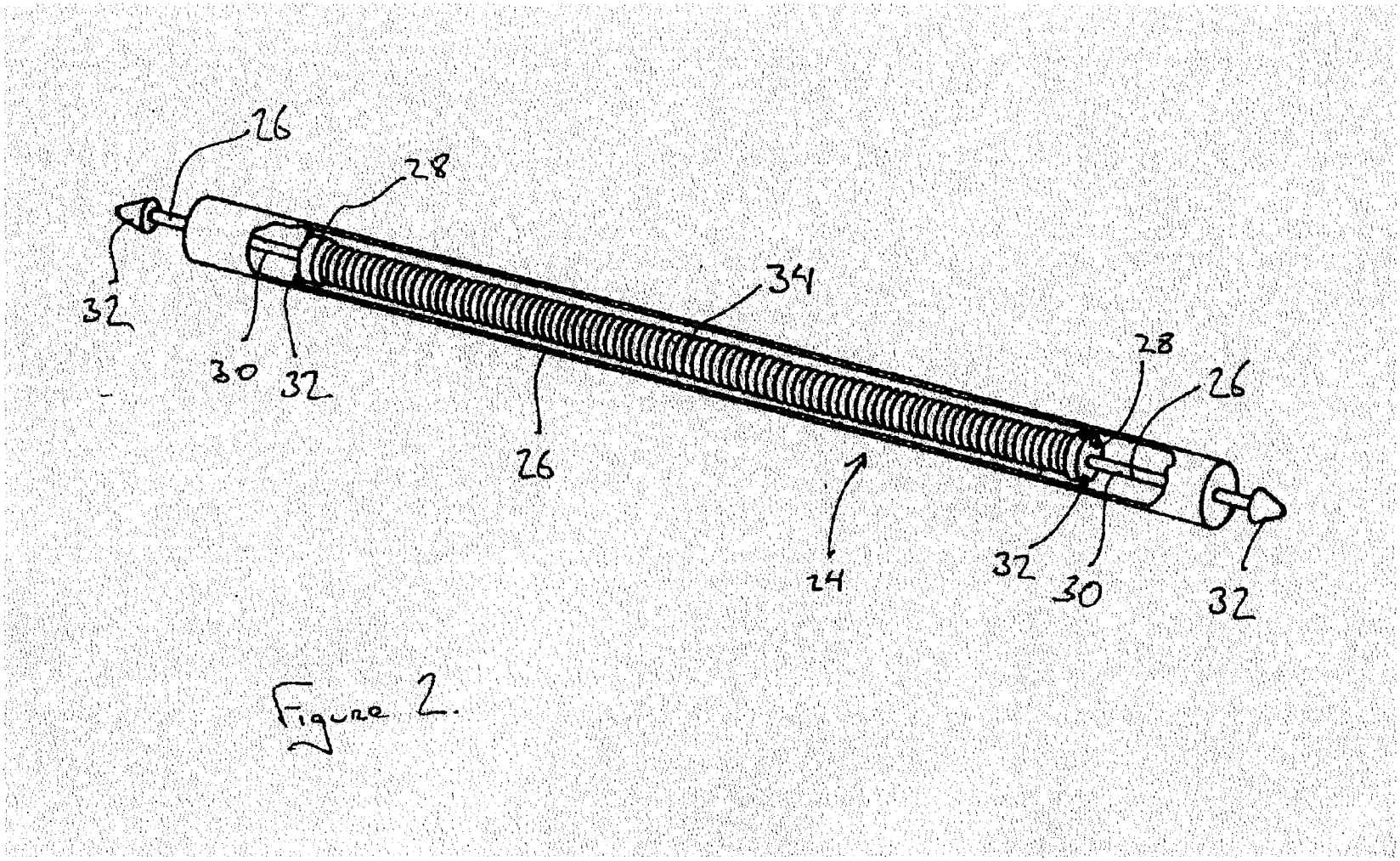
FIG. 2 is a detailed view of a spring loaded connector component incorporated in the disk shuttle of FIG. 1.
Figure 1:
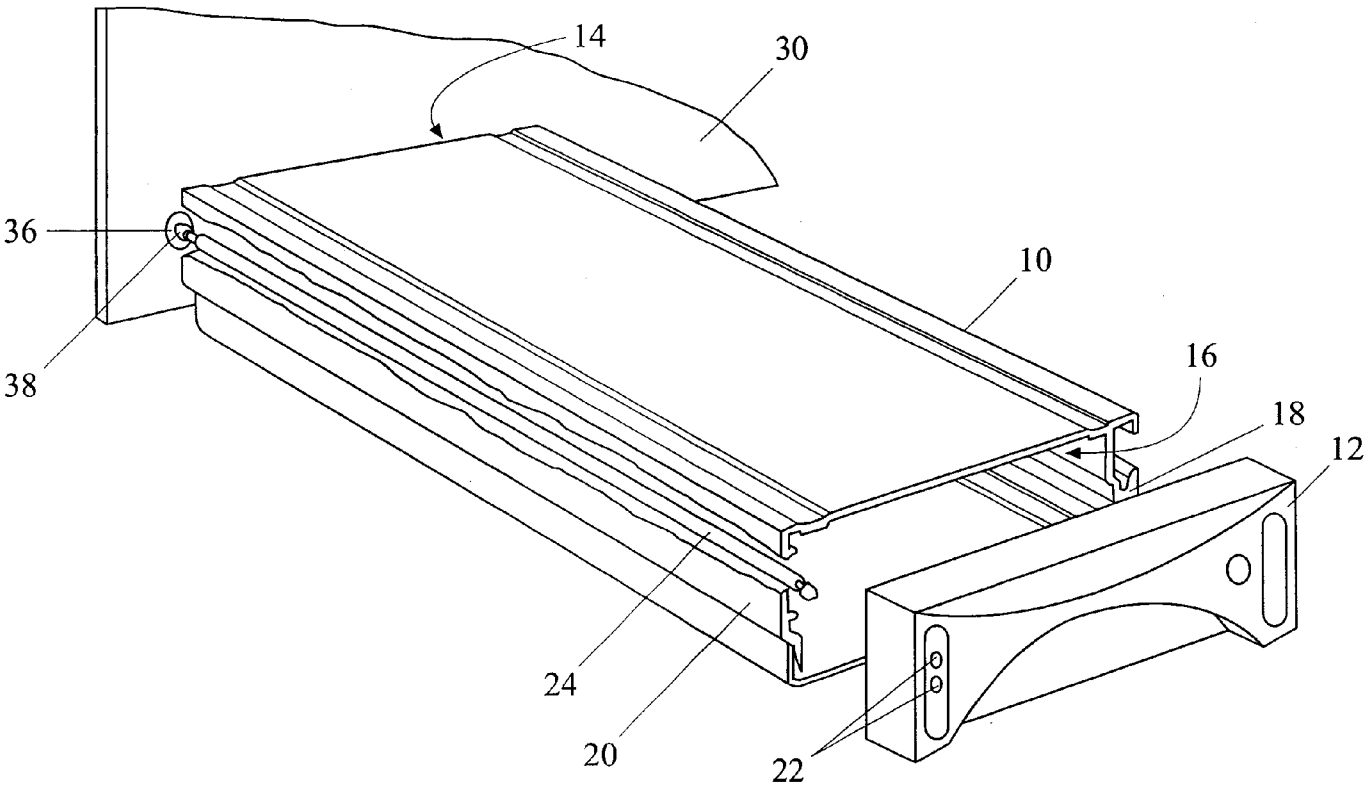
Figure 2:
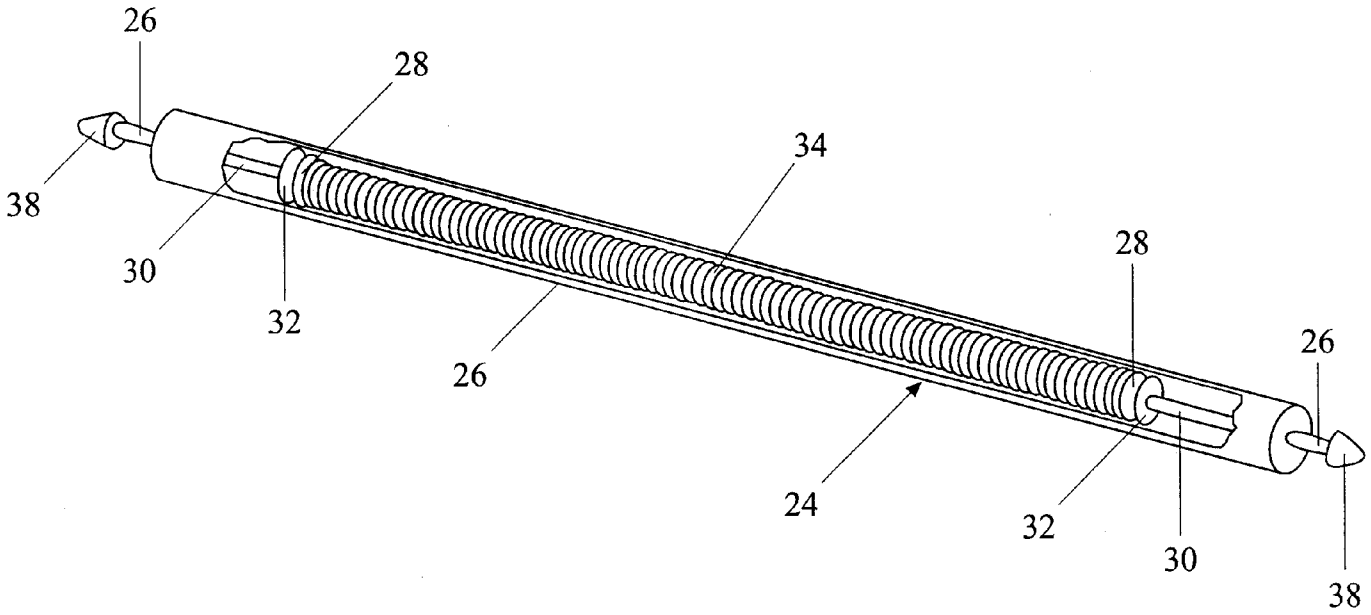

An embodiment of the invention will now be described with reference to the accompanying drawings, in which: FIG. 1 is a perspective view of a disk shuttle according to a preferred embodiment of the invention in operation with a backplane; and FIG. 2 is a detailed view of a spring loaded connector component incorporated in the disk shuttle of FIG. 1.

Referring now to FIG. 1 which shows a field replaceable unit according to the invention. The preferred embodiment is described in terms of a disk shuttle or carrier 10, however, it will be seen that the present invention is applicable to any field replaceable unit including not alone shuttles for other devices such as power supply units, fan units, switch modules and any other rack mountable device, but also for integrated field replaceable units.

Such field replaceable units are adapted to be slidably located within a shelf of an enclosure (not shown) and to make contact with a backplane 30. The backplane 30 in turn includes tracks which enable power, control and/or data circuits to be shared between devices within the enclosure.

The shuttle comprises a hollow casing having a substantially constant rectangular cross-section defining a rear aperture 14 and a front aperture 16 through which a disk drive (not shown) is inserted in the shuttle. Once the disk drive is located within the shuttle, a front plate 12 is clipped over the front aperture of the shuttle.

The disk drive itself includes a connector (not shown) which positively connects to a corresponding connector mounted on the backplane. That is to say that pins within the disk drive connector slide into sockets within the backplane connector to complete the electrical connections from the disk to the backplane.

In the preferred embodiment, the front plate 12 of the disk shuttle 10 also includes some electrical circuitry, in this case, a pair of LED's 22. Other examples include but are not limited to an LCD display or button inputs.

The casing has profiled side walls 18, 20 suitable for locating the assembled shuttle within the rack enclosure in a conventional manner. In the preferred embodiment of the present invention, the side wall 20 of the shuttle incorporates a connector 24 comprising a pair of double pointed spring loaded pins (only one shown) one for each LED running from the front to the rear of the shuttle.

Referring now to FIG. 2 which shows one of the connectors in more detail. Each connector 24 comprises a cylindrical body 26 which may or may not be electrically conductive. For ease of fabrication, the body may, for example, comprise two semi-cylindrical parts snapped or otherwise fixed together. Two pins 26 are located with the body, each comprising a circular base member 28, linked by a shaft 30 which passes through the end of the body 26 to an electrically conductive contact 38, which in the present example is conical. A coil spring 34 is located in the body 26 between the two base members 28 and tends to urge each of the pins 26 out of the body. In the preferred embodiment, extension of the coil spring is limited by stop members 32 within the body, and compression of the spring is limited to the point the contacts 38 engage respective end faces of the body 26.

If each of the pins 26 is completely electrically conductive, then it is sufficient for the coil spring to be conductive to ensure electrical continuity between the pin contacts 38. To ensure this further, the coil spring 34, could in fact be soldered or otherwise fixedly connected to each of the base members 28.

Alternatively, if the spring were not made from electrically conductive material, then the circuit from pin to pin could be completed through an electrically conductive connector body—although this may prove more difficult to shield than a conductive spring.

Referring back to FIG. 1, the length of the connector 24 is such that the front facing contact makes contact with and is compressed by a pad (not shown) located at the rear of the front plate 12 as the front plate is located on the shuttle. Furthermore, when the disk shuttle 10 is inserted in the rack enclosure, the rear facing contact is brought into contact with and compressed by an electrical pad 36 located on the backplane and tends to compress the spring 34 so completing an electrical circuit from the backplane 30 to the LED or any electrical electronic or electro-mechanical input or output device located within the front plate 12.

While the preferred embodiment has been described in relation to a double-ended connector, it will be seen that many of the advantages of the invention are derived simply from the provision of the single contact connecting the FRU to the backplane 30.

What is claimed is:

1. A field replaceable unit comprising:

a housing having a front and a rear and being configured for sliding insertion into and out of a rack from the rear of the housing; and a connector for, in use, completing an electrical circuit from a backplane of said rack to a component of said field replaceable unit, said connector comprising a first rear projecting electrically conductive spring loaded member operative to engage an electrical pad on said backplane when said housing is inserted in said rack, said connector comprising a second front projecting electrically conductive spring loaded member electrically coupled to said first electrically conductive spring loaded member; and a front plate removable attached to said housing and including said component; wherein said connector is operative, when said front plate is attached to said housing, to engage a second pad electrically coupled to said component and disposed behind said front plate.

2. A field replaceable unit as claimed in claim 1 wherein said electrically conductive member is adapted to engage a pad on said backplane.

3. A field replaceable unit as claimed in claim 1 wherein said connector transmits one or both of an input or an output signal.

4. A rack enclosure including the backplane and at least one field replaceable unit according to claim 1 operatively connected to said backplane.

* * * * *

UNITED STATES PATENT AND TRADEMARK OFFICE

CERTIFICATE OF CORRECTION

PATENT NO. : 6,419,528 B2
DATED : July 16, 2002
INVENTOR(S) : Mullins et al.

It is certified that error appears in the above-identified patent and that said Letters Patent is hereby corrected as shown below:

Title page,
Include item [30], Foreign Application Priority Data,

-- July 6, 2000 (IE)..... S2000/0547
September 7, 2000 (IE)..... S2000/0712 --.

The title page, showing an illustrated figure, should be deleted and substitute therefor the attached Title page.

Drawings,
Please delete drawings sheets 1 and 2, and substitute therefor the informal drawings sheets 1 and 2, consisting of drawing figures 1 and 2, as shown on the attached pages. Amendment dated 1/5/2002.

Signed and Sealed this

Seventeenth Day of December, 2002

JAMES E. ROGAN
*Director of the United States Patent and Trademark Office*

1/2

(12) United States Patent
Mullins et al.

(10) Patent No.: US 6,419,528 B2
(45) Date of Patent: Jul. 16, 2002

(54) FIELD REPLACEABLE UNIT

(75) Inventors: Barrie Jeremiah Mullins, Wicklow; Aedan Diarmuid Cailean Coffey, Kilkenny, both of (IE)

(73) Assignee: Richmount Computers Limited, Dublin (IE)

( * ) Notice: Subject to any disclaimer, the term of this patent is extended or adjusted under 35 U.S.C. 154(b) by 0 days.

(21) Appl. No.: 09/681,706

(22) Filed: May 23, 2001

(51) Int. Cl.[7] ..... H01R 13/24
(52) U.S. Cl. ..... 439/700; 361/727
(58) Field of Search ..... 439/700, 824, 439/297, 298, 490, 489, 488; 361/685, 724–727

(56) References Cited

U.S. PATENT DOCUMENTS 3,406,368 A * 10/1968 Curran ..... 439/700
5,509,813 A * 4/1996 Lu ..... 439/700
5,997,360 A * 12/1999 Gen-Kuong et al. ..... 439/700
6,050,658 A 4/2000 O'Sullivan et al.

* cited by examiner

*Primary Examiner*—Gary F. Paumen
*Assistant Examiner*—Felix O. Figueroa
(74) *Attorney, Agent, or Firm*—Oppedahl & Larson LLP

(57) ABSTRACT

A field replaceable unit comprises a housing having a front and a rear and is configured for sliding insertion into and out of a rack from its rear. The unit includes a connector for, in use, completing an electrical circuit from a backplane of the rack to a component of the field replaceable unit. The connector comprises a first rear projecting electrically conductive spring loaded member operative to engage an electrical pad on the backplane when the housing is inserted in the rack.

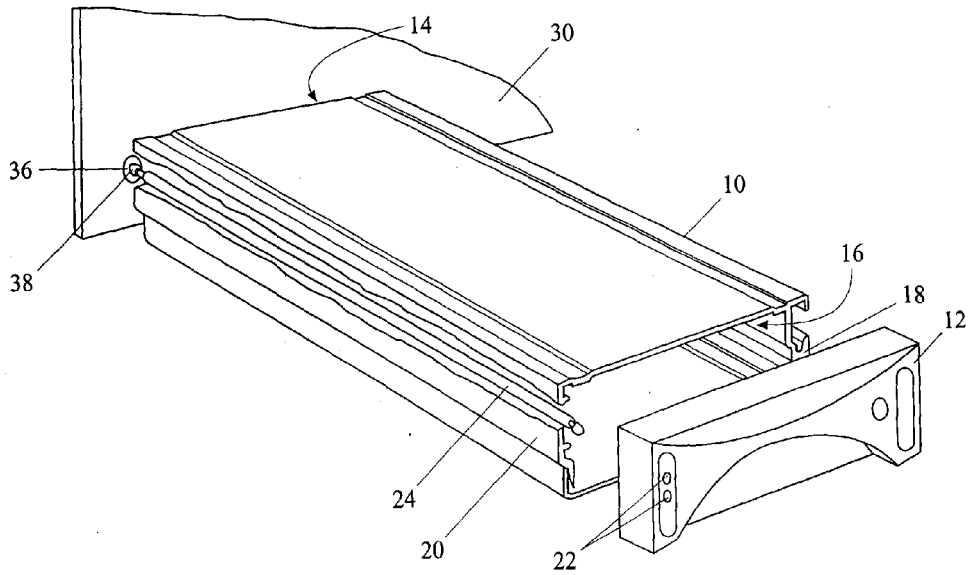

4 Claims, 2 Drawing Sheets